US011781370B2

(12) United States Patent
Fontijn

(10) Patent No.: US 11,781,370 B2
(45) Date of Patent: Oct. 10, 2023

(54) ADJUSTABLE FLUSH THRESHOLD FOR SLIDING DOORS AND WINDOWS

(71) Applicant: GOLDBRECHT LLC, Culver City, CA (US)

(72) Inventor: Marcel Fontijn, Culver City, CA (US)

(73) Assignee: GOLDBRECHT LLC, Culver City, CA (US)

( * ) Notice: Subject to any disclaimer, the term of this patent is extended or adjusted under 35 U.S.C. 154(b) by 39 days.

(21) Appl. No.: 17/340,376

(22) Filed: Jun. 7, 2021

(65) Prior Publication Data

US 2022/0389753 A1 Dec. 8, 2022

(51) Int. Cl.
*E06B 1/70* (2006.01)
*E06B 3/46* (2006.01)

(52) U.S. Cl.
CPC ..... *E06B 1/70* (2013.01); *E06B 3/4636* (2013.01)

(58) Field of Classification Search
CPC ..... E06B 1/70; E06B 3/4636
USPC ..... 49/411, 468
See application file for complete search history.

(56) References Cited

U.S. PATENT DOCUMENTS 3,510,985 A * 5/1970 Smits ..... E05D 15/0665 49/504
4,074,464 A * 2/1978 McCay ..... E06B 1/70 49/468
4,084,289 A * 4/1978 Naimo ..... E06B 3/4636 16/87 R
4,156,325 A * 5/1979 McMullen ..... E06B 1/70 49/468
4,387,535 A * 6/1983 Corbo ..... E06B 1/70 49/468
5,230,181 A * 7/1993 Geoffrey ..... E06B 1/70 49/475.1
5,469,666 A * 11/1995 Lewis, Jr. ..... E06B 1/70 52/177
5,598,665 A * 2/1997 Guddas ..... E06B 3/4609 49/404
5,611,173 A * 3/1997 Headrick ..... E06B 1/70 49/467
6,345,477 B1 * 2/2002 Kepler ..... E06B 1/70 49/468
6,484,446 B2 * 11/2002 Young ..... E06B 1/70 52/212
7,389,611 B2 * 6/2008 Palenske ..... E06B 1/70 49/468
7,814,711 B2 * 10/2010 Milligan ..... E04B 2/7401 52/220.1
8,683,747 B2 * 4/2014 Kim ..... E06B 7/14 49/404
10,612,291 B2 * 4/2020 Bryant ..... E06B 1/70
11,299,887 B2 * 4/2022 Pylypczak ..... E04B 2/7401
(Continued)

*Primary Examiner* — Marcus Menezes
(74) *Attorney, Agent, or Firm* — Sughrue Mion, PLLC

(57) ABSTRACT

A sliding door or window system includes a track. The track includes an outer housing; an inner housing within the outer housing; a guide body provided with the inner housing and configured to guide a sliding movement of a door or a window; and at least one adjustable body that is provided on the outer housing, at least partially within the inner housing, and fixed with respect to the inner housing in a vertical direction, the at least one adjustable body configured to change a height of the inner housing with respect to the outer housing by rotating, such as to change a height of the guide body.

18 Claims, 5 Drawing Sheets

(56) References Cited

U.S. PATENT DOCUMENTS

| | | | | |
|---|---|---|---|---|
| 2004/0200153 | A1* | 10/2004 | Khanlarian | E06B 1/70 49/468 |
| 2006/0053695 | A1* | 3/2006 | Palenske | E06B 1/70 49/468 |
| 2006/0112644 | A1* | 6/2006 | Pepper | E06B 1/70 49/468 |
| 2012/0085037 | A1* | 4/2012 | Van Camp | E06B 1/70 49/467 |
| 2017/0016268 | A1* | 1/2017 | Reyes | E06B 1/70 |
| 2019/0226257 | A1* | 7/2019 | Fontijn | E05D 15/0656 |
| 2019/0383078 | A1* | 12/2019 | Tsimbikos | E06B 3/46 |
| 2020/0048954 | A1* | 2/2020 | Wang | E06B 7/2316 |
| 2020/0408016 | A1* | 12/2020 | Hernandez | E06B 7/22 |

* cited by examiner

ADJUSTABLE FLUSH THRESHOLD FOR SLIDING DOORS AND WINDOWS

BACKGROUND

Technical Field

Embodiments of the present disclosure relate to sliding doors and windows, and more particularly an adjustable flush threshold for sliding doors and windows.

Description of Related Art

Conventional methods and apparatuses for moving windows, doors, and other elements in a frame may include sliding and or positioning an element in and along a track.

SUMMARY

There is a need for sliding door systems that accommodate requirements under the Americans with Disabilities Act for door thresholds.

Embodiments of the present disclosure may provide solutions to such need and/or other needs.

Embodiments of the present disclosure may provide an adjustable flush sill that is a bottom-supported sliding door threshold that allows for up and down adjustment of the threshold to assure a barrier-free traverse over the threshold even with deflection or settlement in a building structure. The threshold may allow for easy maintenance due to simple removal of a cover strip.

According to one or more embodiments, a sliding door or window system is provided. The sliding door or window system includes a track. The track includes: an outer housing; an inner housing within the outer housing; a guide body provided with the inner housing and configured to guide a sliding movement of a door or a window; and at least one adjustable body that is provided on the outer housing, at least partially within the inner housing, and fixed with respect to the inner housing in a vertical direction, the at least one adjustable body configured to change a height of the inner housing with respect to the outer housing by rotating, such as to change a height of the guide body.

According to an embodiment, the at least one adjustable body includes a threaded body and a body with a threaded hole in which the threaded body is provided.

According to an embodiment, each of the at least one adjustable body is a bolt.

According to an embodiment, the sliding door or window system further includes an intermediate connector that is configured to attach to the door or the window, and to slide on the guide body, wherein a height of the intermediate connector changes with a change of the height of the guide body, due to rotation of the at least one adjustable body.

According to an embodiment, the intermediate connector includes a groove that accommodates the guide body.

According to an embodiment, the inner housing includes at least one roller mechanism that is configured to slidably support the intermediate connector.

According to an embodiment, the inner housing includes at least one first accommodation space that accommodates the at least one adjustable body, and the at least one first accommodation space is at least partially defined by a protrusion that is configured to fix the at least one adjustable body with respect to the inner housing in the vertical direction.

According to an embodiment, the inner housing further includes: at least one roller mechanism; and at least one second accommodation space that accommodates the at least one roller mechanism.

According to an embodiment, one of the at least one first accommodation space and one of the at least one second accommodation space together form a continuous internal space of the inner housing.

According to an embodiment, the at least one adjustable body is a plurality of adjustable bodies, including a pair of the adjustable bodies, each of the pair of the adjustable bodies separated from each other in a direction perpendicular to the direction of the sliding movement.

According to an embodiment, the inner housing further includes a pair of roller mechanisms, and each of the pair of roller mechanisms separated from each other in the direction perpendicular to the direction of the sliding movement.

According to an embodiment, the plurality of adjustable bodies further includes another pair of the adjustable bodies, each of the another pair of the adjustable bodies separated from each other in the direction perpendicular to the direction of the sliding movement, and the another pair of the adjustable bodies separated from the pair of the adjustable bodies in the direction of the sliding movement.

According to an embodiment, the inner housing further includes a plurality of roller mechanisms, each of the plurality of roller mechanisms provided adjacent to a respective one of the plurality of adjustable bodies.

According to an embodiment, the sliding door or window system further includes the door.

According to an embodiment, the sliding door or window system further includes the window.

According to one or more embodiments, a method of adjusting a track of a sliding door or window system is provided. The method includes: changing a height of a guide body, of the track, that is provided with an inner housing of the track and configured to guide a sliding movement of a door or a window. The changing includes changing a vertical height of at least one adjustable body, of the track, by rotating the at least one adjustable body such that a height of the inner housing and the height of the guide body are changed, wherein the at least one adjustable body is provided on the outer housing of the track, fixed with respect to the inner housing in a vertical direction, and at least partially within the inner housing.

According to an embodiment, the at least one adjustable body comprises a threaded body and a body with a threaded hole in which the threaded body is provided According to an embodiment, each of the at least one adjustable body is a bolt.

According to an embodiment, the at least one adjustable body is a plurality of adjustable bodies, including a pair of the adjustable bodies, each of the pair of the adjustable bodies separated from each other in a direction perpendicular to the direction of the sliding movement.

According to an embodiment, the plurality of adjustable bodies further includes another pair of the adjustable bodies, each of the another pair of the adjustable bodies separated from each other in the direction perpendicular to the direction of the sliding movement, and the another pair of the adjustable bodies separated from the pair of the adjustable bodies in the direction of the sliding movement.

BRIEF DESCRIPTION OF THE DRAWINGS

Further features, the nature, and various advantages of the disclosed subject matter will be more apparent from the following detailed description and the accompanying drawings in which.

DETAILED DESCRIPTION

The terms used in the description are intended to describe embodiments only, and shall by no means be restrictive. Unless clearly used otherwise, expressions in a singular from include a meaning of a plural form. In the present description, an expression such as "comprising" or "including" is intended to designate a characteristic, a number, a step, an operation, an element, a part or combinations thereof, and shall not be construed to preclude any presence or possibility of one or more other characteristics, numbers, steps, operations, elements, parts or combinations thereof.

Figure 1:
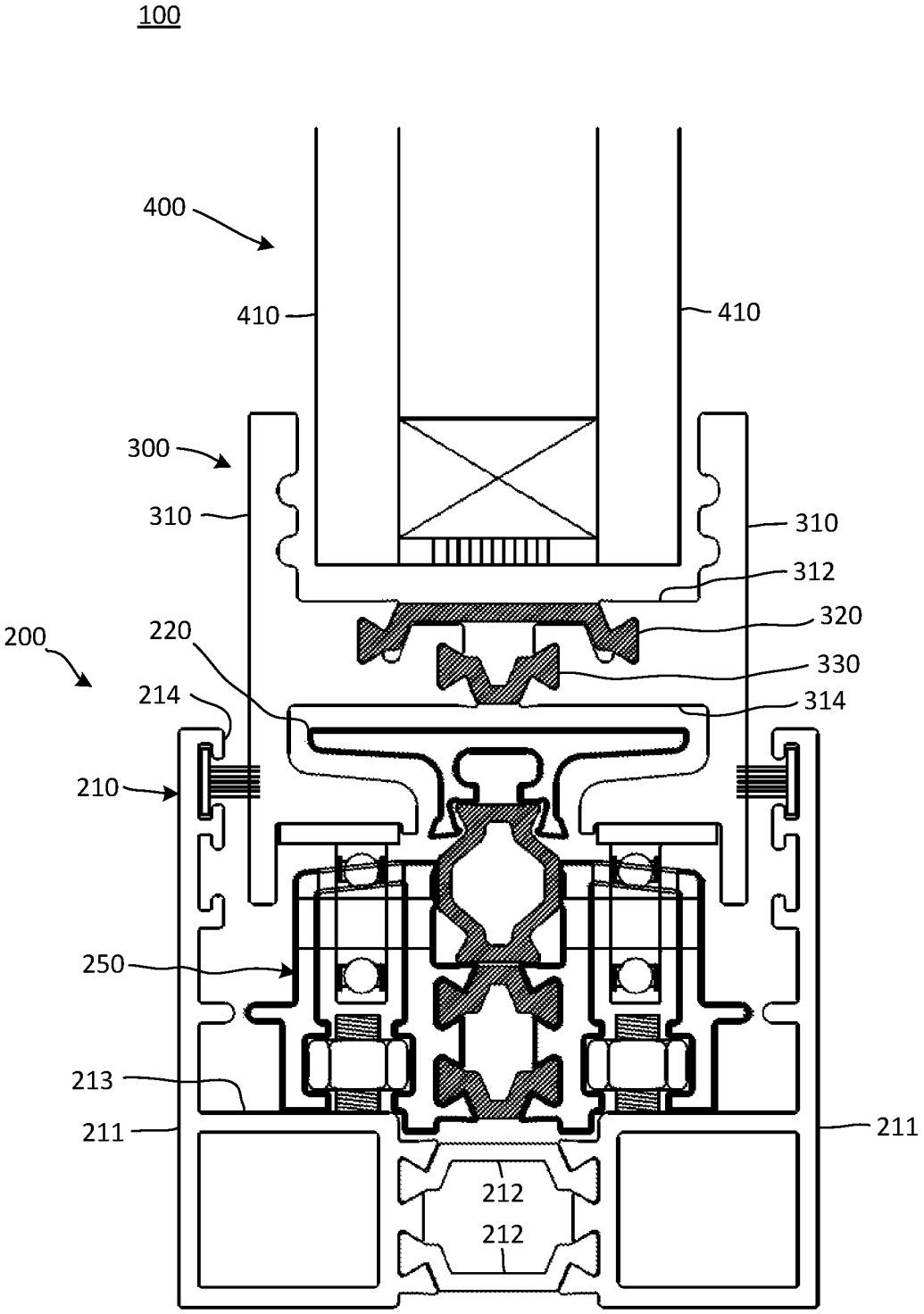
FIG. 1 illustrates a side view of a sliding door system according to an embodiment of the present disclosure.
Figure 2:
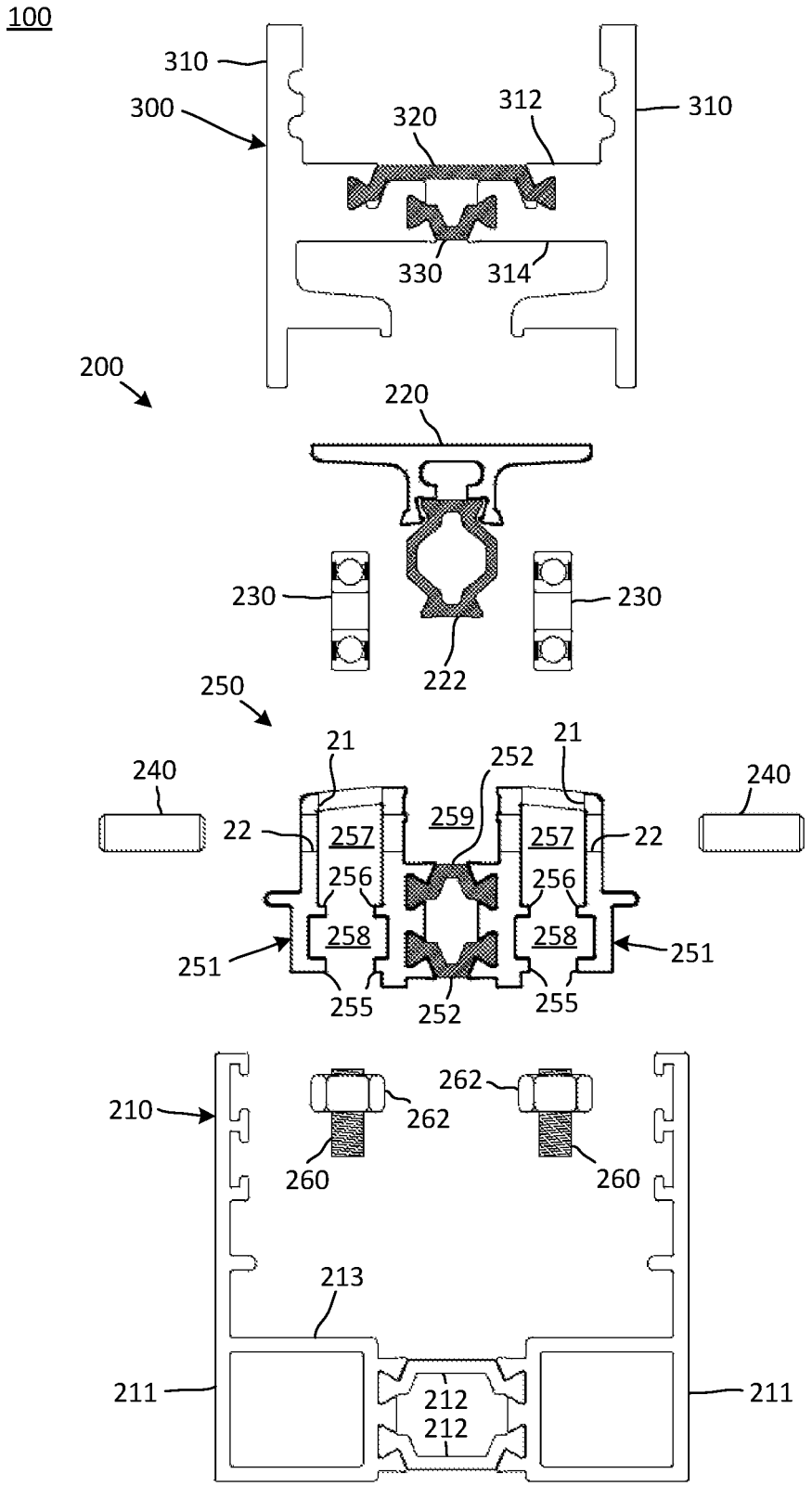
FIG. 2 illustrates an exploded view of the sliding door system, according to an embodiment of the present disclosure.
Figure 3:
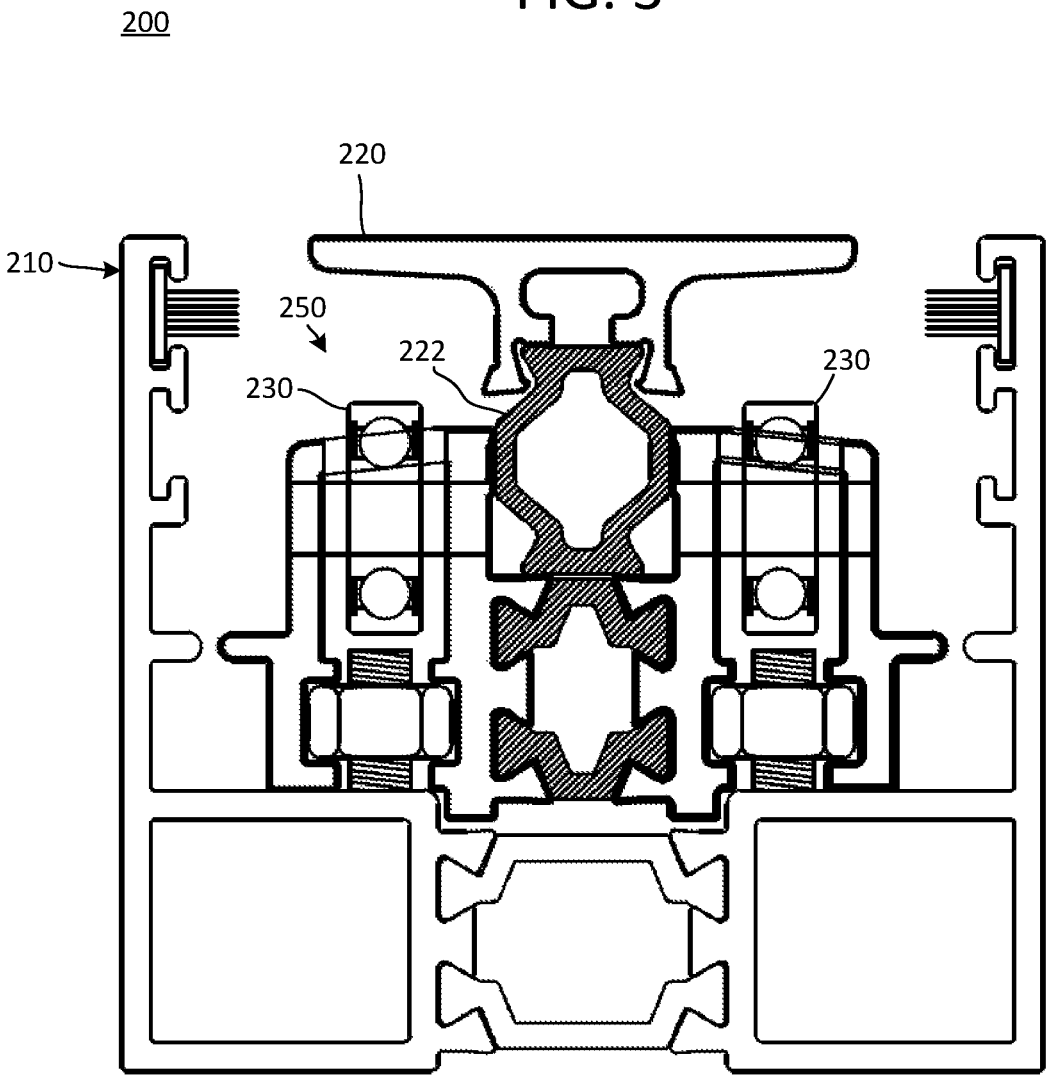
FIG. 3 illustrates a side view of the track of the sliding door system in a lowered position, according to an embodiment of the present disclosure.
Figure 4:
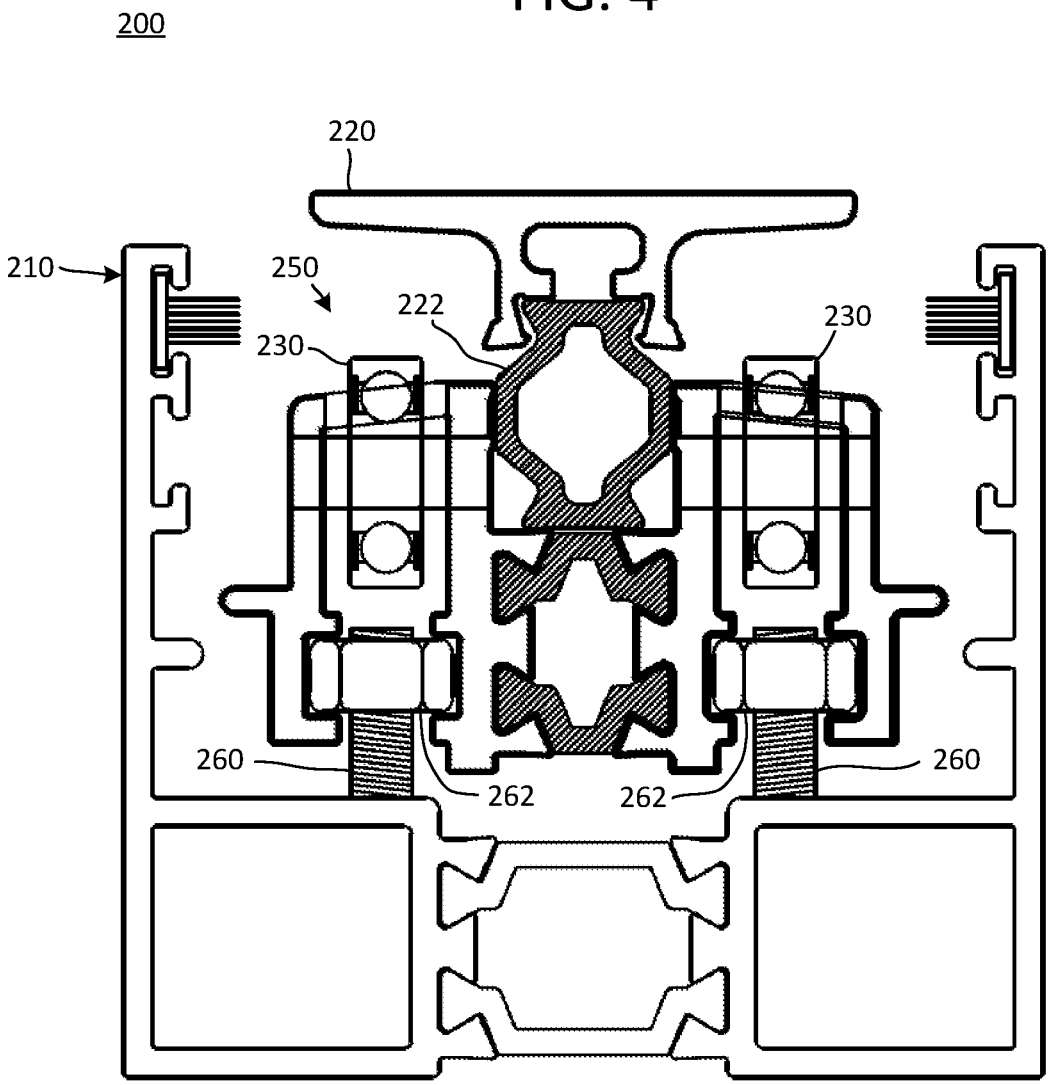
FIG. 4 illustrates a side view of the track of the sliding door system in a raised position, according to an embodiment of the present disclosure.
Figure 5:
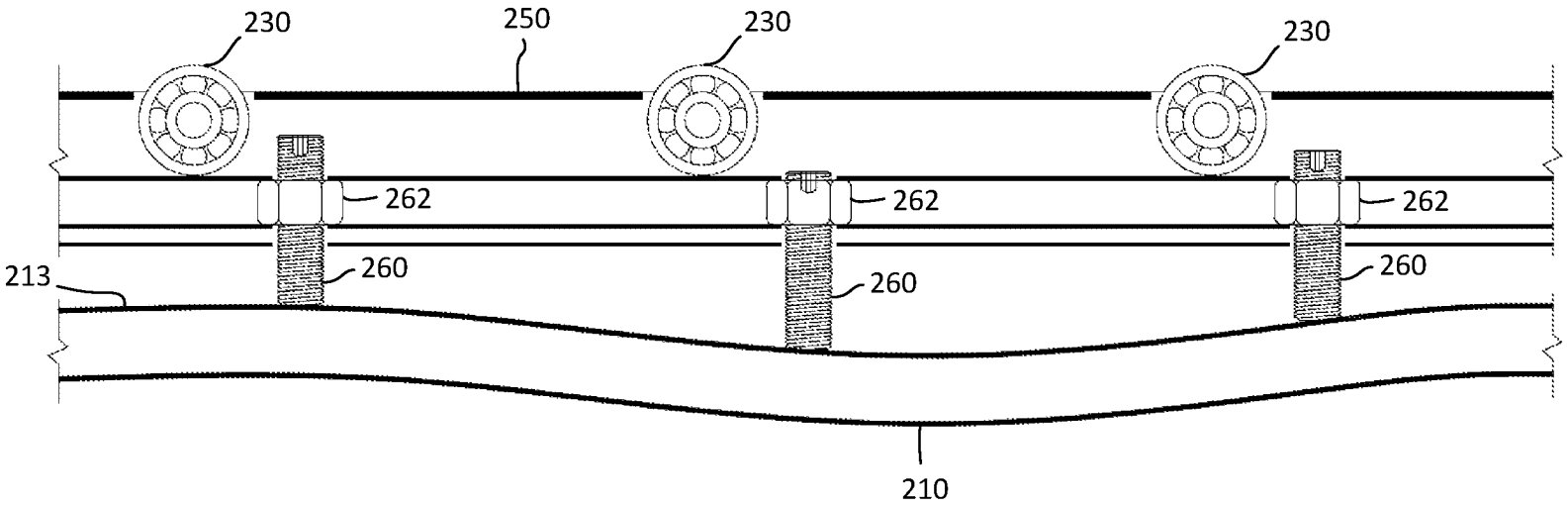
FIG. 5 is a diagram illustrating aspects of the track of FIG. 1 from a front view, according to an embodiment of the present disclosure.

With reference to FIGS. 1-5, a sliding door system 100 according to an embodiment of the present disclosure is described. FIG. 1 illustrates a side view of the sliding door system 100, FIG. 2 illustrates an exploded view of the sliding door system 100, according to an embodiment of the present disclosure, FIG. 3 illustrates a side view of the track 200 of the sliding door system 100 in a lowered position, FIG. 4 illustrates a side view of the track 200 of the sliding door system 100 in a raised position, and FIG. 5 is a diagram illustrating aspects of the track 200 of FIG. 1 from a front view, according to an embodiment of the present disclosure. In the present disclosure, a side view of the sliding door system 100 and a side view of the track 200 refer to a view taken in a direction parallel to a sliding direction of the panel 400 (e.g. parallel to an extending direction of the panel 400). In the present disclosure, a front view of the track 200 refers to a view taken from a direction towards a main face of a sliding door associated with the track 200, perpendicular to the sliding direction of the sliding door.

The sliding door system 100 may include a track 200, an intermediate connector 300, and a panel 400. The intermediate connector 300 may connect the panel 400 to the track 200, and may be configured to slide with the panel 400 along the track 200, in the sliding direction of the panel 400 (i.e. into and out of the page of FIG. 1).

According to an embodiment, the panel 400 may be a glass sliding door. For example, the panel 400 may include one or more panels 410 that are made of glass. However, the panel 400 is not limited thereto, and may be made alternatively or additionally of any material including, for example, metal and/or wood. According to an embodiment, the panel 400 may instead be a window.

The intermediate connector 300 may be formed of one or more bodies 310 that form a main body of the intermediate connector 300. For example, as shown in FIG. 1, the intermediate connector 300 may include two bodies 310. The two of bodies 310 may be arranged such as to mirror each other along a direction parallel to the sliding direction of the panel 400. The two bodies 310 may be connected to each other by a connector 320 and a connector 330. The arrangement of the one or more bodies 310 may form a first groove 312 that is configured to receive the panel 400, and a second groove 314, opposite to the first groove 312, that is configured to receive a guiding body (e.g. a T-wing body 220 described below) of the track 200.

According to an embodiment, the first groove 312 may have a shape that is configured to firmly fix the panel 400 therein, such that the panel 400 substantially does not move relative to the intermediate connector 300 during a sliding operation of the panel 400. Alternatively or additionally, the panel 400 may be connected to the intermediate connector 300 by at least one fastener (e.g. nails, screws, bolts, etc.), gasket, or bond.

According to an embodiment, the second groove 314 may have a shape that is configured to receive the guiding body (e.g. the T-wing body 220) of the track 200. For example, the second groove 314 may substantially have a T-shape in which the second groove 314 has an opening at a bottom side of the intermediate connector 300, extends upward from the opening, and extends in two horizontal directions, opposite to each other, that are perpendicular to the sliding direction of the panel 400. However, the second groove 314 may have a different shape depending on a shape of the guiding body of the track 200. The second groove 314 may have a shape that enables the intermediate connector 300, with the panel 400, to slide with respect to the guiding body (e.g. the T-wing body 220) of the track 200 that is within the second groove 314. For example, the second groove 314 may not firmly fix the T-wing body 220 of the track. As an alternative or addition to the second groove 314, the track 200 may include a groove and the intermediate connector 300 may include a projection that is configured to fit into the groove of the track 200, such that the intermediate connector 300 is slidably connected to the track 200.

According to an embodiment, the one or more bodies 310, including the first groove 312 and the second groove 314, may be elongated in the sliding direction of the panel 400, such as to have a length that is shorter, equal to, or longer than the panel 400.

Referring to FIGS. 1-2, the track 200 is described below. In FIG. 2, illustration of the panel 400 is omitted for clarity.

The track 200 may include an outer housing 210, a T-wing body 220, a connector 222, roller mechanisms 230 (e.g. bearings), shafts 240, an inner housing 250, and first adjustable bodies 260.

Referring to FIG. 1, the outer housing 210 may be configured as an outer shell of the track 200 that accommodates other components of the track 200. For example, the outer housing 210 may accommodate the T-wing body 220, the connector 222, the roller mechanisms 230, the shafts 240, the inner housing 250, and the first adjustable bodies 260. A vertical end of the outer housing 210, facing towards the panel 400, may include an elongated opening 214 that enables the intermediate connector 300 to at least be partially accommodated in the outer housing 210, and enables the T-wing body 220 and the intermediate connector 300 to move into and out of the outer housing 210 when the track 200 is adjusted, as described below.

The outer housing 210 may be formed of one or more outer housing bodies 211. For example, as shown in FIG. 1, the outer housing 210 may include two outer housing bodies 211. The two outer housing bodies 211 may be arranged such as to mirror each other along a direction parallel to the sliding direction of the panel 400. The two outer housing bodies 211 may be connected to each other by one or more connectors 212. The arrangement of the one or more outer housing bodies 211 may form an inner space that accommodates the other components of the track 200, and that opens to an outside of the track 200 via the elongated opening 214.

According to embodiments, the outer housing 210, including the inner space and the elongated opening 214, may be elongated in the sliding direction of the panel 400 such as to define at least a sliding length of the panel 400 and the intermediate connector 300. According to embodiments, the outer housing 210 has a length greater than the intermediate connector 300, but the length is not limited thereto.

Referring to FIG. 2, the inner housing 250 may be formed of one or more inner housing bodies 251. For example, the inner housing 250 may include two inner housing bodies 251. The two inner housing bodies 251 may be arranged such as to mirror each other along a direction parallel to the sliding direction of the panel 400. The two inner housing bodies 251 may be connected to each other by one or more connectors 252. The arrangement of the one or more inner housing bodies 251 may form a center groove 259 that accommodates a connector 252 that connects the T-wing body 220 to the inner housing 250. The center groove 259 may extend in the sliding direction of the panel 400 such as to accommodate the connector 222 that is connected to the T-wing body 220, both of which may also extend in the sliding direction of the panel 400.

Additionally, each of the inner housing bodies 251 may include a first accommodation portion 257 and a second accommodation portion 258. The first accommodation portion 257 may be an inner space of the inner housing bodies 251 that at least partially accommodates at least one of the roller mechanisms 230. The second accommodation portion 258 may be an inner space of the inner housing bodies 251 that accommodates at least one of second adjustable bodies 262 that are respectively connected to the first adjustable bodies 260.

With reference to FIG. 5, pairs of the plurality of roller mechanisms 230 may be arranged in the sliding direction of the panel 400 (left/right of the page with respect to FIG. 5), each roller mechanism of the pair being in a respective one of the first accommodation portion 257 (refer to FIGS. 1-2). Also, pairs of the first adjustable bodies 260 and corresponding pairs of the second adjustable bodies 262 may be arranged in the sliding direction of the panel 400, each first adjustable body of the pair and second adjustable body of the pair being in a respective one of the second accommodation portion 258. In embodiments of the present disclosure, the number and spacing of the pairs of the plurality of roller mechanisms 230, and the pairs of the first adjustable bodies 260 with the second adjustable bodies 262, may be adjusted depending on the weight of the panel 400. According to embodiments, the pairs of the first adjustable bodies 260 with the second adjustable bodies 262 may be provided adjacent to a corresponding pair of the roller mechanisms 230.

With reference to FIG. 2, according to embodiments, the first accommodation portion 257 may include an opening 21, at a first side of the inner housing 250 facing towards the panel 400, in which the at least one of the roller mechanisms 230 protrude outwards such that the at least one of the roller mechanisms 230 is configured to contact the intermediate connector 300 (refer to FIG. 1). According to embodiments, the first accommodation portion 257 may extend in the sliding direction of the panel 400 such as to accommodate a plurality of the roller mechanisms 230. In such case, the opening 21 may be a single opening that extends in the sliding direction of the panel 400 such as to allow the plurality of the roller mechanisms 230 to protrude therethrough. Alternatively in such case, the opening 21 may be a plurality of openings that are arranged in the sliding direction of the panel 400 such as to allow the plurality of the roller mechanisms 230 to respectfully protrude therethrough. In the case of a plurality of openings, the first accommodation portion 257 may also be a plurality of separate accommodation portions (e.g. internal spaces) that are arranged in the sliding direction of the panel 400 to accommodate a respective one of the roller mechanisms 230, and correspond to the plurality of openings. The roller mechanisms 230 may be inserted into the opening 21 and fixed within the inner housing 250 by a respective one of shafts 240 that are inserted into a respective one of holes 22 of the inner housing 250.

According to embodiments, the second accommodation portion 258 may include an opening (defined at a position of a protrusion 255), at a second side of the inner housing 250 opposite to the first side, such that at least one of first adjustable bodies 260 extends from the inner surface 213 (refer to FIG. 1) of the outer housing 210 into the inner housing 250 via the opening. According to embodiments, the second accommodation portion 258 may extend in the sliding direction of the panel 400 such as to accommodate the at least one of the second adjustable bodies 262. In such case, the opening may be a single opening that extends in the sliding direction of the panel 400 such as to allow a plurality of the first adjustable bodies 260 to be inserted therethrough. Alternatively in such case, the opening may be a plurality of openings that are arranged in the sliding direction of the panel 400 such as to allow the plurality of the first adjustable bodies 260 to respectfully be inserted therethrough. In the case of a plurality of openings, the second accommodation portion 258 may also be a plurality of separate accommodation portions that are arranged in the sliding direction of the panel 400 to accommodate a respective one of the second adjustable bodies 262, and correspond to the plurality of openings.

According to embodiments, the first accommodation portion 257 and the second accommodation portion 258 may together form a continuous internal space. Additionally, the continuous internal space may include at least one protrusion 256 between the first accommodation portion 257 and the second accommodation portion 258. The second accommodation portion 258 may be defined by the at least one protrusion 255 and the at least one protrusion 256. The at least one protrusion 256 and the at least one protrusion 255 may be configured to contact upper and lower faces of the at least one of the second adjustable bodies 262, respectively, such that the at least one protrusion 255 and the at least one protrusion 256 fix the at least one of the second adjustable bodies 262 relative to the inner housing 250 in the vertical direction. Accordingly, as described further below, the second adjustable bodies 262, when adjusted, may cause the inner housing 250 to raise and lower with the T-wing body 220, the intermediate connector 300, and the panel 400.

Referring to FIGS. 1-2, the T-wing body 220 may have a T-shape that includes dual wings. The T-wing body 220 may be connected to the inner housing 250 by the connector 222, and may be inserted into the second groove 314 of the intermediate connector 300. Accordingly, the panel 400 and the intermediate connector 300 may be slidably connected to the track 200, and more particularly slidably connected to the T-wing body 220 and the inner housing 250. For example, the intermediate connector 300 (and the panel 400) may slide in the sliding direction of the panel 400, with respect to the track 200, along the T-wing body 220 while slidably supported by the roller mechanisms 230. According to embodiments, the T-wing body 220 may be extended in the sliding direction of the panel 400 to define a sliding length of the panel 400. Also, according to embodiments, the T-wing body 220 may have a shape other than a T-shape that includes one or more projections and/or grooves that are configured to fit with a corresponding portion (e.g. the second groove 314) of the intermediate connector 300 to guide sliding of the intermediate connector 300.

Referring to FIGS. 1-4, the second adjustable bodies 262 may be configured to move upwards and downwards to adjust a height of the inner housing 250, including the components therein. Accordingly, by connecting relationships, the second adjustable bodies 262 may adjust the heights of the T-wing body 220, the intermediate connector 300, and the panel 400. The second adjustable bodies 262 may be provided on the first adjustable bodies 260. According to embodiments, the second adjustable bodies 262 may be nuts and the first adjustable bodies 260 may be bolts (e.g. set bolts).

According to embodiments, the second adjustable bodies 262 may each include a threaded hole in which the first adjustable bodies 260 (e.g. threaded bodies) are provided. Accordingly, the first adjustable bodies 260 may be rotated with respect to the second adjustable bodies 262 such as to raise and lower with respect to the second adjustable bodies 262, thereby adjusting a height of the inner housing 250. By adjusting locations of the second adjustable bodies 262 on the first adjustable bodies 260, by rotating the first adjustable bodies 260, a height of the threshold (e.g. the top surface of the T-wing body 220) can be adjusted to assure a barrier-free traverse over the threshold even with deflection or settlement in a building structure.

According to embodiments, locations of the second adjustable bodies 262 on the first adjustable bodies 260 may be adjusted during initial installation or after installation. According to embodiments, the first adjustable bodies 260 may be adjusted via access from the top and may be turned in or out to move up or down with respect to the second adjustable bodies 262.

As shown in FIG. 3, a height of the second adjustable bodies 262, relative to the first adjustable bodies 260, may be adjusted such that a top surface of the T-wing body 220 is flush with a top of the outer housing 210. As shown in FIG. 4, the height of the second adjustable bodies 262, relative to the first adjustable bodies 260, may be adjusted such that the top surface of the T-wing body 220 is above the top of the outer housing 210. The first adjustable bodies 260 may be configured to be adjusted such as change the height of the top surface of the T-wing body 220 to be in positions between the positions illustrated in FIGS. 3-4 and, in some embodiments, greater than or lower than such positions. By adjusting a height of the T-wing body 220 and the inner housing 250, the intermediate connector 300 and the panel 400 may be raised and lowered.

According to embodiments, the connectors 212, 222, 252, 320, and 330 may be made of various materials that are the same or different from each other. According to embodiments, any number of the connectors 212, 222, 252, 320, and 330 may be made of a same or different non-conductive material and thereby may act as thermal breaks between one or more portions to which those connectors may be connected so as to resist thermal energy transfer between those portions while maintaining connection therebetween.

According to embodiments, the outer housing bodies 211, the T-wing body 220, the inner housing bodies 251, and the body 310 may be made of various materials that are the same or different from each other. According to embodiments, the outer housing bodies 211, the T-wing body 220, the inner housing bodies 251, and the body 310 are made of a same or different type of metal.

According to embodiments, any number of the first groove 312 and the second groove 314 of the intermediate connector 300; the center groove 259, the first accommodation portion 257, and the second accommodation portion 258 of the inner housing 250; and the elongated opening 214 of the outer housing 210 may be elongated such as to form openings at one or more longitudinal ends of the components in which they are formed.

According to embodiments, up and down adjustment of a threshold is provided to assure a barrier-free traverse over the threshold even with deflection or settlement in a building structure, and compliance with the Americans with Disabilities Act may be achieved.

It should be noted that although a few non-limiting example embodiments have been described, those skilled in the art will readily appreciate that many modifications are possible to the example embodiments without departing from the scope of the present disclosure. Therefore, it is to be understood that the foregoing is illustrative of various example embodiments and is not to be construed as limited to the specific example embodiments described herein.

What is claimed is:

1. A sliding door or window system comprising:

a track comprising:

an outer housing;

an inner housing within the outer housing;

a guide body provided with the inner housing and configured to guide a sliding movement of a sliding door or a window;

at least one adjustable body that is provided on the outer housing, at least partially within the inner housing, the at least one adjustable body comprises a threaded body that is engaged with a threaded hole, and the threaded hole is fixed with respect to the inner housing in a vertical direction; and an intermediate connector that is configured to attach to the sliding door or the window, and to slide on the guide body;

wherein a bottom end of the threaded body is in contact with an upper surface of the outer housing, and a bottom end of the inner housing is above the upper surface of the outer housing, wherein the at least one adjustable body is configured to change a height of the inner housing with respect to the outer housing, such as to change a height of the guide body, by relative vertical movement of the threaded hole with respect to the threaded body due to relative rotation of the threaded body with respect to the threaded hole, and wherein a height of the intermediate connector changes with a change of the height of the guide body, due to the relative rotation of the threaded body with respect to the threaded hole.

2. The sliding door or window system of claim 1, wherein the at least one adjustable body comprises the threaded body and a body that includes the threaded hole, and the body is fixed with respect to the inner housing in the vertical direction.

3. The sliding door or window system of claim 1, wherein the threaded body is a bolt.

4. The sliding door or window system of claim 1, wherein the intermediate connector includes a groove that accommodates the guide body.

5. The sliding door or window system of claim 1, wherein the inner housing includes at least one roller mechanism that is configured to slidably support the intermediate connector.

6. The sliding door or window system of claim 1, further comprising the sliding door.

7. The sliding door or window system of claim 1, further comprising the window.

8. A sliding door or window system comprising:

a track comprising:

an outer housing;

an inner housing within the outer housing;

a guide body provided with the inner housing and configured to guide a sliding movement of a sliding door or a window; and at least one adjustable body that is provided on the outer housing, at least partially within the inner housing, the at least one adjustable body comprises a threaded body that is engaged with a threaded hole, and the threaded hole is fixed with respect to the inner housing in a vertical direction, wherein a bottom end of the threaded body is in contact with an upper surface of the outer housing, and a bottom end of the inner housing is above the upper surface of the outer housing, wherein the at least one adjustable body is configured to change a height of the inner housing with respect to the outer housing, such as to change a height of the guide body, by relative vertical movement of the threaded hole with respect to the threaded body due to relative rotation of the threaded body with respect to the threaded hole, wherein the at least one adjustable body comprises the threaded body and a body that includes the threaded hole, and wherein the body is fixed with respect to the inner housing in the vertical direction, wherein the inner housing includes at least one first accommodation space that accommodates the body of the at least one adjustable body, and wherein the at least one first accommodation space is at least partially defined by a protrusion that is configured to fix the body with respect to the inner housing in the vertical direction.

9. The sliding door or window system of claim 8, wherein the inner housing further includes:

at least one roller mechanism; and at least one second accommodation space that accommodates the at least one roller mechanism.

10. The sliding door or window system of claim 9, wherein one of the at least one first accommodation space and one of the at least one second accommodation space together form a continuous internal space of the inner housing.

11. A sliding door or window system comprising:

a track comprising:

an outer housing;

an inner housing within the outer housing;

a guide body provided with the inner housing and configured to guide a sliding movement of a sliding door or a window; and at least one adjustable body that is provided on the outer housing, at least partially within the inner housing, the at least one adjustable body comprises a threaded body that is engaged with a threaded hole, and the threaded hole is fixed with respect to the inner housing in a vertical direction, wherein a bottom end of the threaded body is in contact with an upper surface of the outer housing, and a bottom end of the inner housing is above the upper surface of the outer housing, wherein the at least one adjustable body is configured to change a height of the inner housing with respect to the outer housing, such as to change a height of the guide body, by relative vertical movement of the threaded hole with respect to the threaded body due to relative rotation of the threaded body with respect to the threaded hole, and wherein the at least one adjustable body is a plurality of adjustable bodies, including a first pair of the adjustable bodies, the first pair of the adjustable bodies separated from each other in a direction perpendicular to the direction of the sliding movement.

12. The sliding door or window system of claim 11, wherein the inner housing further includes a pair of roller mechanisms, and the pair of roller mechanisms is separated from each other in the direction perpendicular to the direction of the sliding movement.

13. The sliding door or window system of claim 11, wherein the plurality of adjustable bodies further includes a second pair of the adjustable bodies, the second pair of the adjustable bodies separated from each other in the direction perpendicular to the direction of the sliding movement, and the second pair of the adjustable bodies separated from the first pair of the adjustable bodies in the direction of the sliding movement.

14. The sliding door or window system of claim 13, wherein the inner housing further includes a plurality of roller mechanisms, the plurality of roller mechanisms provided adjacent to a respective one of the plurality of adjustable bodies.

15. A method of adjusting a track of a sliding door or window system, the track including at least one adjustable body, the at least one adjustable body including a threaded body that is engaged with a threaded hole, the method comprising:

changing a height of a guide body of the track, that is provided with an inner housing of the track and configured to guide a sliding movement of a sliding door or a window, the changing comprising:

changing a height of the inner housing with respect to an outer housing of the track by causing relative rotation of the threaded body with respect to the threaded hole such as to cause relative vertical movement of the threaded hole with respect to the threaded body, wherein the threaded hole is fixed with respect to the inner housing in a vertical direction such that the relative vertical movement of the threaded hole with respect to the threaded body causes the height of the inner housing to change, wherein the at least one adjustable body is provided on the outer housing of the track at least partially within the inner housing, wherein a bottom end of the threaded body is in contact with an upper surface of the outer housing, and a bottom end of the inner housing is above the upper surface of the outer housing, and wherein the at least one adjustable body is a plurality of adjustable bodies, including a first pair of the adjustable bodies, the first pair of the adjustable bodies separated from each other in a direction perpendicular to the direction of the sliding movement.

16. The method of claim 15, wherein the at least one adjustable body includes the threaded body and a body that includes the threaded hole, and the body is fixed with respect to the inner housing in the vertical direction.

17. The method of claim 15, wherein the threaded body is a bolt.

18. The method of claim 15, wherein the plurality of adjustable bodies further includes a second pair of the adjustable bodies, the second pair of the adjustable bodies separated from each other in the direction perpendicular to the direction of the sliding movement, and the second pair of the adjustable bodies separated from the first pair of the adjustable bodies in the direction of the sliding movement.

* * * * *